US009044959B2

(12) United States Patent
Conesa et al.

(10) Patent No.: US 9,044,959 B2
(45) Date of Patent: Jun. 2, 2015

(54) PRINTING SYSTEMS AND METHODS FOR OPERATING PRINTING SYSTEMS

(75) Inventors: Eduardo Amela Conesa, Granyena de Segarra Lleida (ES); Jacint Humet Pous, Santa Perpetua de Mogoda Barcelona (ES); Marc Serra Vail, Barcelona (ES); Jaime Fernández del Rio, Calella Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/346,255

(22) PCT Filed: Sep. 21, 2011

(86) PCT No.: PCT/EP2011/066471

§ 371 (c)(1),
(2), (4) Date: Mar. 21, 2014

(87) PCT Pub. No.: WO2013/041139

PCT Pub. Date: Mar. 28, 2013

(65) Prior Publication Data

US 2014/0225952 A1 Aug. 14, 2014

(51) Int. Cl.
*B41J 2/21* (2006.01)

(52) U.S. Cl.
CPC ..... *B41J 2/2132* (2013.01); *B41J 2/2114* (2013.01); *B41J 2/2135* (2013.01); *B41J 2/2139* (2013.01)

(58) Field of Classification Search
CPC ..... B41J 3/543; B41J 2/2114; B41J 2/2132; B41J 2/2135; B41J 2/213
USPC ..... 347/14, 15, 20–21, 45, 95
See application file for complete search history.

(56) References Cited

U.S. PATENT DOCUMENTS

| | | | | |
|---|---|---|---|---|
| 6,312,082 | B1 | 11/2001 | Lund | |
| 6,378,976 | B1 | 4/2002 | Byers | |
| 7,261,405 | B2 | 8/2007 | Ohya | |
| 7,533,982 | B2 | 5/2009 | Yoneyama | |
| 8,573,725 | B2 * | 11/2013 | Snyder et al. | 347/14 |
| 2009/0244120 | A1 | 10/2009 | Yamazaki | |
| 2009/0244149 | A1 | 10/2009 | Yamazaki | |
| 2011/0123209 | A1 | 5/2011 | Akita | |

FOREIGN PATENT DOCUMENTS

| | | | |
|---|---|---|---|
| GB | 2391306 | A | 2/2004 |
| JP | 2007011007 | A | 1/2007 |
| JP | 2010186016 | A | 8/2010 |

OTHER PUBLICATIONS

Patent Cooperation Treaty, International Search Report and Written Opinion, mailed Jun. 18, 2012 for International Application No. PCT/EP2011/066471, 8 pages.

* cited by examiner

*Primary Examiner* — Thinh Nguyen
(74) *Attorney, Agent, or Firm* — Hewlett-Packard Patent Department

(57) ABSTRACT

Methods performed by a printing system are described herein. A portion of a print area is located by operating an optical sensor to respond to a color shift. The color shift is from a printed reference color. The color shift is caused by a fixer fluid applied to the portion. Printing systems and tangible machine readable storage mediums are also described herein.

13 Claims, 9 Drawing Sheets

PRINTING SYSTEMS AND METHODS FOR OPERATING PRINTING SYSTEMS

BACKGROUND

Some printing systems form a printed image by ejecting ink from ink printheads. Thereby, ink is applied onto a print medium for printing a pattern of individual dots at particular locations. The printed pattern reproduces an image on the printing medium. At least some of these printing systems are commonly referred to as inkjet printers.

A fixer fluid may be used for improving print quality of a printed pattern. In particular, a fixer fluid may address coalescence, bleed, or similar effects characterized by ink or pigment migration across a printed surface. A printing system may include a treatment printhead configured to eject a fixer fluid over the print medium. The treatment printhead applies the fixer fluid by ejecting the fixer over the particular locations for ink placement. Thereby, the fixer treats ink on the print medium in order to address the above mentioned effects. The fixer fluid may be applied before, after or, quasi-simultaneously to the application of the ink.

Some printing systems implement automatic sensing of fixer fluid applied on a print medium. Automatic sensing of fixer on the print medium may facilitate determining whether: a) a particular treatment printhead ejects, in fact, fixer fluid; b) the treatment printhead applies fixer fluid at selected nominal positions; and/or c) the treatment printhead applies fixer fluid at selected nominal densities or flow volumes.

An optical detector may be configured for sensing fixer fluid applied to a print medium. However, sensing of a fixer fluid applied on a print medium can be challenging. For example, optical detectors may have a too low sensitivity for suitably detecting fixer fluid on the print medium.

BRIEF DESCRIPTION OF THE DRAWINGS

The Figures depict examples, implementations, and configurations of the invention, and not the invention itself.

DETAILED DESCRIPTION

In the foregoing description, numerous details are set forth to provide an understanding of the examples disclosed herein. However, it will be understood by those skilled in the art that the examples may be practiced without these details. Further, in the following detailed description, reference is made to the accompanying drawings, in which various examples are shown by way of illustration. In this regard, directional terminology, such as "top," "bottom," "front," "back," "leading," "trailing," "left," "right," "vertical,", etc., is used with reference to the orientation of the Figure(s) being described. Because disclosed components can be positioned in a number of different orientations, the directional terminology is used for purposes of illustration and is in no way limiting.

While a limited number of examples have been disclosed, those skilled in the art will appreciate numerous modifications and variations therefrom. It is intended that the appended claims cover such modifications and variations as fall within the true spirit and scope of the examples.

A fixer fluid is a fluid that facilitates reducing mobility of ink on a print medium. Fixer fluids are typically materials that may be applied beneath a colored ink drop (pre-coats or undercoats) and/or materials that may be applied over a colored ink drop (post-coats or overcoats.) Further examples of fixer fluids are detailed below. As set forth above, a fixer fluid is typically used for improving print quality of a printed pattern by addressing at least one of coalescence, bleed, or similar effects characterized by ink or pigment migration across a printed surface.

Methods for locating a treated portion of a print area are described herein. As used herein, a treated portion refers to a portion of a print medium to which a fixer fluid is applied. The fixer fluid applied to the treated portion may cause a color shift from a reference color. The treated portion is located by operating an optical sensor to respond to the color shift. Further, the optical sensor may be operated with a light emission device selected from a plurality of light emission devices. A selected light emitting device (LED) and a reference color may be predetermined for improving the response of the optical sensor to the color shift. In some examples herein, the reference color is predetermined by comparing light emission spectra from a plurality of printed colors. In some examples herein, a selected light emitting device is predetermined by comparing a light emission spectrum from a printed test color and a light emission spectrum from a printed color shifted from the test color by applying the fixer fluid. Moreover, both an LED and a reference color may be predetermined for optimizing the optical sensor response by choosing an LED and a reference color that maximize the optical sensor response to the color shift caused by a fixer fluid.

Figure 1:
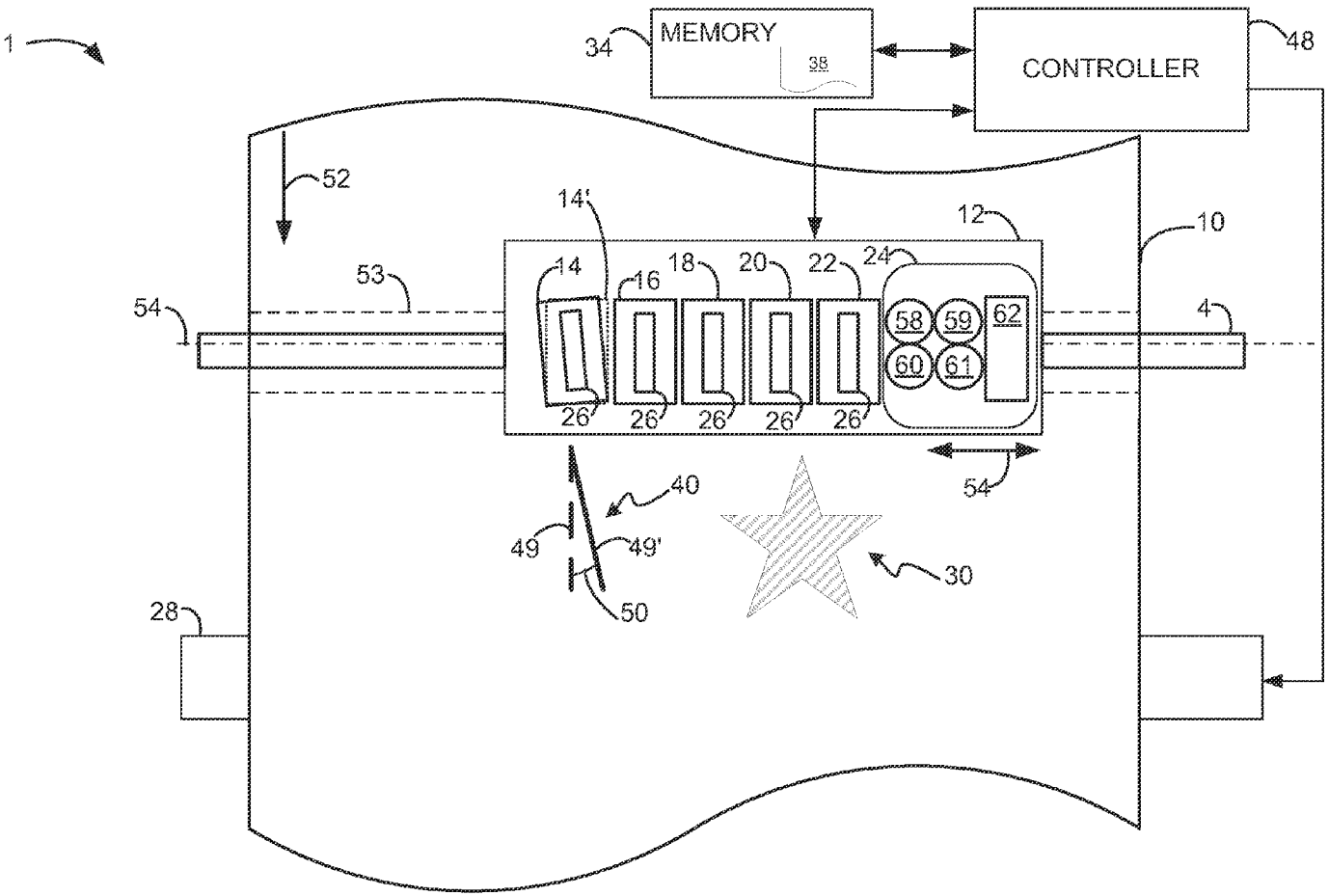
FIG. 1 is a schematic diagram of a portion of a printing system according to an example.

The diagram of FIG. 1 shows a portion of a printing system 1 according to an example. Printing system 1 is for reproducing an image 30 on a print medium 10. Typically, printing system 1 is an inkjet printer. Printing system 1 includes a movable carriage 12 mounted on a carriage rod 4. In the illustrated example, carriage 12 supports four ink printheads 16, 18, 20 (which constitute a printhead assembly), a treatment printhead 14, and an optical sensor 24 for locating printed areas on print medium 10. Optical sensor 24 includes a light detection device 62 and an assembly of Light Emitting Devices (LED). In particular, optical sensor 24 includes four LEDs 58, 59, 60, 61. Further, printing system 1 includes a print media transport assembly 28, on which print medium 10 is supported and advanced in a media advance direction 52. A controller 48 is operatively connected to a memory device 34 and the above elements of printing system 1.

As used herein, a printhead is a device typically including a nozzle or a nozzle array 26 through which drops of a fluid (e.g., an ink or a fixer) can be ejected. The particular fluid ejection mechanism within the printhead may take on a variety of different forms such as, but not limited to, those using piezo-electric or thermal printhead technology.

Each of ink printheads 16, 18, 20, 22 is configured to eject ink of a different color (referred to as base colors). In particular, ink printheads 16, 18, 20, 22 are fluidly connected to an ink reservoir (not shown). The ink reservoir includes separated reservoirs for providing different ink types to the ink printheads. Thereby, base colors and secondary colors may be reproduced on print medium 10. Base colors are reproduced on print medium 10 by depositing a drop of a required ink type onto a dot location. Secondary or shaded colors are reproduced by depositing drops of different base colors on adjacent dot locations; the human eye interprets the color mixing as the secondary color or shading. Commonly used ink types include cyan ink, magenta ink, yellow ink, and black ink.

A treatment printhead as used herein is a printhead configured to eject fixer fluid for treating an area of a print medium. A treatment printhead is fluidly connected to a fixer fluid reservoir (not shown) for providing fixer fluid to the treatment printhead.

It will be appreciated that the printing system may include any suitable number of printheads. In some examples, printing system 1 may include at least one treatment printhead, such as two or more treatment printheads. In a further example, printing system 1 may include at least one ink printhead, such as two to six ink printheads, or even more ink printheads. Further, a printhead of printing system 1 may be a disposable printhead or a fixed printhead, which is designed to last for the whole operating life of printing system 1.

Controller 48 is configured to execute methods described herein. Controller 48 may be implemented, for example, by one or more discrete modules (or data processing components) that are not limited to any particular hardware, firmware, or software (i.e., machine readable instructions) configuration. Controller 48 may be implemented in any computing or data processing environment, including in digital electronic circuitry, e.g., an application-specific integrated circuit, such as a digital signal processor (DSP) or in computer hardware, firmware, device driver, or software (i.e., machine readable instructions). In some implementations, the functionalities of the modules are combined into a single data processing component. In other versions, the respective functionalities of each of one or more of the modules are performed by a respective set of multiple data processing components.

Memory device 34 is accessible by controller 48. Memory device 34 stores process instructions (e.g., machine-readable code, such as computer software) for implementing methods executed by controller 48, as well as data that controller 48 generates or processes such as alignment correction data 38. Memory device 34 may include one or more tangible machine-readable storage media. Memory devices suitable for embodying these instructions and data include all forms of computer-readable memory, including, for example, semiconductor memory devices, such as EPROM, EEPROM, and flash memory devices, magnetic disks such as internal hard disks and removable hard disks, magneto-optical disks, and ROM/RAM devices.

Controller 48 is operatively connected to treatment printhead 14, ink printheads 16, 18, 20, 22, and the respective reservoirs to control operation thereof, in particular ejection of ink and fixer fluid for printing a pattern on print medium 10 (such as an image 30). Controller 48 receives print job commands and data from a print job source (not shown), which may be a computer source or other source of print jobs. Controller 48 acts on the received commands to provide motion control signals to: i) print media transport assembly 28 to advance print medium 10 in the media advance direction 52; and ii) carriage 12 to traverse across print medium 10. Controller 48 may generate the motion control signals in consideration of estimation of printhead misalignments, for example by using calibration data stored in memory device 34. Further, controller 48 provides firing signals to nozzle arrays 26 in the respective printheads in order to eject ink and/or fixer at particular locations on print medium 10.

For printing, controller 48 generates motion signals for engendering a relative movement between the printheads mounted on carriage 12 and print medium 10. In the illustrated example, carriage 12 traverses over a printing surface of print medium 10 along an axis 54 and print medium 10 is advanced in a media advance direction 52. It will be appreciated that printing system 1 may engender relative displacement between the printing printheads and the print medium in different manners such as, but not limited to, scanning of carriage 12 over an area of print medium extending along the vertical and horizontal directions.

The length of nozzle arrays 26 defines a print swath or band 53. The width of this band is commonly referred to as the "swath width", which defines the maximum pattern of ink or fixer fluid which can be laid down in a single transition of carriage 12. Print medium 10 is typically held stationary while the printheads complete a print swath. Typically, after carriage 12 traverses a print swath 53, print medium 10 is advanced in direction 52 and carriage 12 traverses again for printing another portion of print medium 10. Advance of print medium 10 may be performed after a back and forth transition of carriage 12 over print swath 53. Typically, print medium 10 is advanced a fraction of the swath width. Thereby, ink and/or fixer on a particular spot of print medium 10 can be deposited from different nozzles of a printhead in successive transitions of carriage 12 over the particular spot.

Optical sensor 24 is configured to detect positions of marks printed on print medium 10. Optical sensor 24 may detect printed marks by i) emitting light from LEDs 58, 59, 60, 61, ii) illuminating a portion of a printed mark with the emitted light, and iii) detecting light reflected from the illuminated portion by operating light detection device 62.

As used herein, an LED refers to a device capable of emitting light in a selected spectral bandwidth. A selected spectral bandwidth corresponds to a particular color. For example, LEDs 58, 59, 60, 61 of optical sensor 24 may include a blue LED, a green LED, an orange LED, and red LED. Further, light detection device 62 (or, more particularly, its spectral bandwidth of detection) is typically chosen for being capable of detecting light reflected from markings printed with the base colors. It will be understood that this configuration of optical sensor 24 is not limiting and other configurations are contemplated. For example, optical sensor 24 may include two LEDs and be configured for detecting cyan, magenta, and black ink. Optical sensor 24 typically includes focusing means for suitably emitting and collecting light.

Optical sensor 24 may be used for estimating a misalignment of an ink printhead. For estimating misalignment of an ink printhead, printing system 1 may print a set of test patterns (not shown) by activation of selected nozzles in selected ink printheads. Printing system 1 operates carriage 12 for scanning optical sensor 24 over the printed test patterns. During scanning, optical sensor 24 emits light on particular portions of print medium 10 and detects light reflected from these portions. Thereby, optical sensor 24 registers areas of the test markings and provides corresponding electrical signals to controller 48. Optical sensor 24 may also be used to test whether an ink printhead ejects, in fact, ink. Further, optical sensor 24 may additionally be used to determine whether an ink printhead applies ink at the nominal densities or flow volume.

Figure 2:
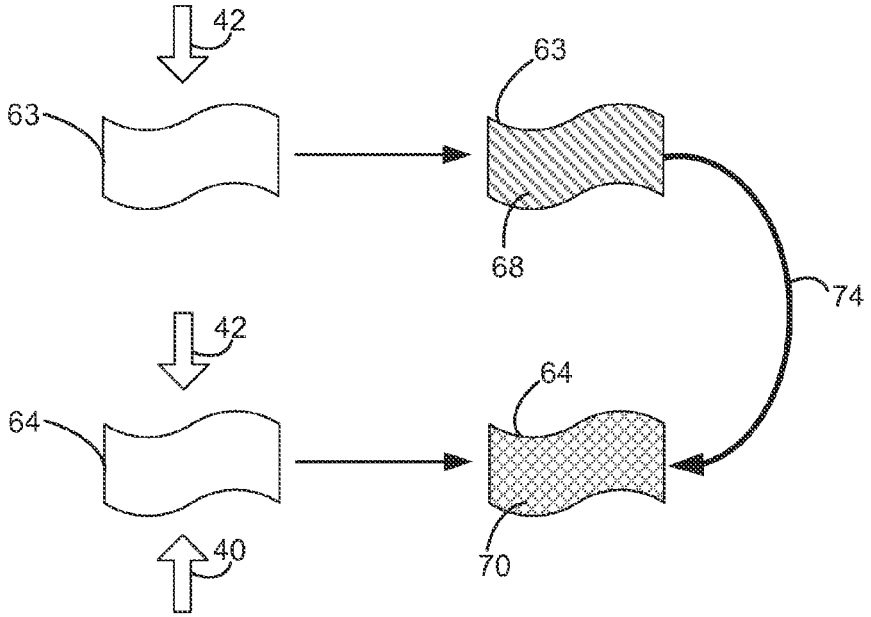
FIG. 2 is a simplified diagram of a printing pattern printed by a printing system according to examples herein.

As set forth above, optical sensor 24 can be used to locate a portion of a print area treated with fixer fluid by operating optical sensor to respond to a color shift from a reference color. The color shift is caused by the fixer fluid, as illustrated in FIG. 2. Method described herein may be performed for a fixer fluid which is transparent to detection by the optical sensor. As used herein, transparent to detection indicates that a printing system cannot directly detect, in a reliable manner, a fixer fluid deposited on the print medium using the optical sensor.

FIG. 2 is a simplified diagram of a printing pattern printed by printing system 1. As shown in the upper part of the diagram, controller 48 may operate one or more of ink printheads 16, 18, 20, 22 for applying an ink selection 42 onto a portion 63 of print medium 10. Thereby, a color 68 is printed on portion 63. Color 68 may be a base color or a secondary color depending on the ink selection 42 used.

As shown in the lower part of the diagram, controller 48 may operate treatment printhead 14 and one or more of printheads 16, 18, 20, 22 for applying a fixer fluid 40 and ink selection 42 onto a portion 64 of print medium 10. Thereby a color 70, which is shifted from color 68, is reproduced on portion 64. That is, the interaction of applied fixer fluid 40 with applied ink causes a color shift 74 relative to the color that would be reproduced without fixer, i.e., color 68.

Color shift 74 depends on various factors. Firstly, color shift 74 depends on the type of applied fixer. Further, color shift 74 depends on the quantity of fixer fluid applied to portion 64. Typically, a fixer fluid according to examples herein causes a color shift in the L* coordinate of the color space. Further, a fixer fluid according to examples herein may cause a color shift in other coordinates of the color space, such as the a* or b* coordinates. A DeltaE (dE) parameter of the CIE(L*,a*, b*) 1976 may be used as a measure of the color shift. DeltaE is defined as the geometric distance between two colors in the CIELab colorspace:

$$dE=\sqrt{(L1-L2)^2+(a1-a2)^2+(b1-b2)^2}$$

According to examples herein, fixer fluid 40 may be applied such as to cause a color shift of at least 1 dE or, more specifically, a color shift between 0 and 20 dE.

Figure 3:
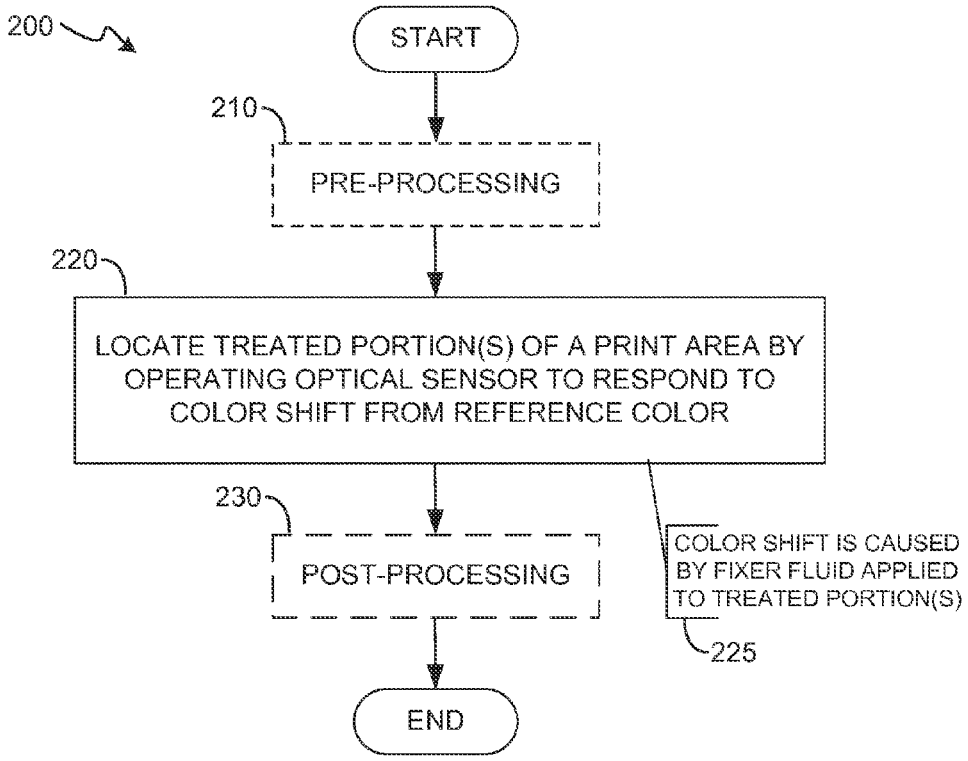
FIG. 3 is a process flow diagram of a method performed by a printing system according to an example herein.

FIG. 3 is a process flow diagram illustrating a method performed by printing system 1 according to an example. The depicted process flow 200 may be carried out by execution of sequences of executable instructions. In an example, the executable instructions are stored in a tangible machine readable storage medium such as, but not limited to, memory device 34. Process flow 200 may be carried out by controller 48 or any other suitable element of a printing system.

Figure 4:
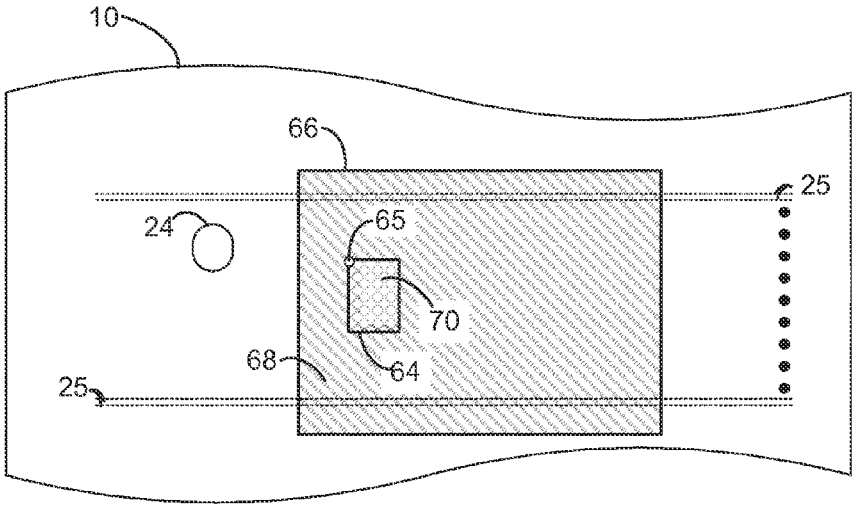
FIG. 4 schematically shows an arrangement for operation of an optical sensor according to an example herein.

Process flow 200 is executed for locating a portion of a print area treated with a fixer fluid. The process flow is typically executed for determining whether a) treatment printhead 14 ejects fixer fluid, b) treatment printhead 14 applies fixer fluid at selected nominal positions, and/or c) the treatment printhead applies fixer fluid at nominal densities or nominal flow volumes. In the following, process flow 200 is described with reference to elements depicted in FIG. 4. FIG. 4 schematically shows an arrangement for operation of an optical sensor according to an example herein.

Process flow 200 typically includes a pre-processing step 210. Pre-processing step 210 may include printing reference color 68 (illustrated by a hatched pattern) on a print area 66. In particular, controller 48 may control the ink printheads so as to print a selected reference color 68 by ejecting an ink selection over print area 66. Reference color 68 may be any color reproducible by printing system 1, such as one of the base colors or any secondary color that may be derived from the base colors.

Pre-processing step 210 may include applying a fixer fluid over a portion 64 of print area 66. In particular, controller 48 may control treatment printhead 14 so as to treat portion 64 by ejecting fixer fluid over that portion. Typically, the fixer fluid is applied before or quasi-simultaneously to the application of the ink selection for reproducing reference color 68. The fixer fluid may also be applied after the ink selection is applied. It will be understood that the portion of print area 66 reproducing reference color 68 do not necessarily have to completely surround the treated portion as illustrated in the figure. Portions of print area 66 reproducing reference color 68 may be disposed in the neighborhood of treated portion 64.

As set forth above, treatment of portion 64 with the fixer fluid may cause a color shift from reference color 68. In particular, the interaction of fixer fluid with ink on print area 66 may produce a physical or chemical reaction that results in a color shift relative to the color that would be reproduced without application of the fixer fluid (i.e., reference color 68). Therefore, application of fixer fluid to portion 64 may result in shifted color 70 (illustrated by a cross-hatched pattern).

Typically, reference color 68 is selected for improving the response of optical sensor 24 to a color shift produced by a particular fixer fluid. For example, reference color 68 may be selected such that the contrast between an area with reference color 68 and an area with shifted color 70 is sufficiently high to be detected by optical sensor 24. Reference color 68 is selected from a color gamut available to printing system 1 during execution of process flow 200. A color gamut refers to a partial subset or a complete set of colors reproducible by printing system 1.

In order to select reference color 68, controller 48 may calculate which reference color is particularly suitable for locating a treated portion in view of a particularly used fixer fluid. Alternatively or additionally thereto, controller 48 may use color values stored in memory device 34 for selecting a reference color. The stored color values may be associated to respective types of fixer fluid so that controller 48 selects a reference color in consideration of the fixer fluid used. Furthermore, reference color 68 may be predetermined according to, for example, methods exemplified below with reference to FIGS. 5, 6A and 6B.

It will be understood that process flow 200 can be performed without requiring execution of a pre-processing step 210 as described above. For example, according to an example, process flow 200 is executed using a pre-printed medium. The pre-printed medium typically includes a background region printed with a reference color or colors. The background region includes an area or areas treated with a fixer fluid applied by a printhead, such that a shifted color is reproduced thereon. The shifted color is such that an optical detector of the printing system can distinguish treated areas from non-treated areas. Such a pre-printed medium may be loaded into printing system 1.

Process flow 200 includes a step 220 of locating a treated portion of a print area by operating optical sensor 24 to respond to a color shift from reference color 68. Step 220 is subject to condition 225, namely that the color shift is caused by a fixer fluid applied to the treated portion. For example, controller 48 may operate carriage 12 for scanning optical sensor 24 over the printed test patterns along scanning lines 25. During scanning, optical sensor 24 emits light on particular areas of print area 60 by operating one or more of the LEDs. Further, optical sensor 24 senses light reflected from the illuminated areas using light detection device 62. The color shift between reference color 68 and shifted color 70 produces a contrast detectable by optical sensor 24. That is, the detected light reflection values respectively corresponding to areas with shifted color 70 and areas with reference color 68 are substantially different (i.e., distinguishable from each other).

Optical sensor 24, or any other suitable element of printing system 1 such as controller 48, registers the detected light reflection values for locating treated portion 64. Further, controller 48 may process the acquired data for correlating light reflection values with corresponding positions. Treated portion 64 can then be located by comparing light reflection values, identifying treated areas in view of the contrast produced by the color shift, and determining the positions of the identified areas. It is noted that locating treated portion 64 may merely include determining that a particular area is treated with fixer fluid. Locating treated portion 64 may further include determining a location 65 of the treated portion.

In step 220, the optical sensor may be operated with an LED selected from the LEDs mounted on the sensor. Typically, the selected LED is selected for facilitating the response of optical sensor 24 to a color shift caused by a particular fixer fluid. In particular, contrast between reference color 68 and shifted color 70 typically depends on the light used for illuminating print area 66 in step 220. Therefore, the response of light detection device 62 to the color shift depends on which LEDs are used for illumination.

The response to the color shift can be improved by selecting a particular LED for illumination. Some particular LEDs may facilitate a better response to color shift than other LEDs in the optical sensor, as further illustrated below with respect to FIGS. 6A and 6B. Further, using LEDs which do not efficiently contribute to the photodetector response may decrease the capability of the optical sensor for detecting a contrast between reference color 68 and shifted color 70 as compared to using only a selected LED or a group of selected LEDs which efficiently contribute to the photodetector response. Therefore, if no particular LED is selected, and all LEDs are used for illumination during location of portion 64, the response of optical sensor 24 to the color shift may be not so efficient as compared to a selection of one or some of the LEDs as described herein.

Accordingly, an LED may be selected during execution of process flow 200. For example, controller 48 may calculate which LED is particularly suitable for locating a treated portion in view of the fixer fluid and the reference color particularly used. Alternatively or additionally thereto, controller 48 may use values stored in memory device 34 for selecting an LED to execute step 220. The stored values may be associated to particular conditions for printing such as which fixer fluid is being used or the particular spectral response of light detection device 62. A LED may be predetermined according to the methods exemplified below with reference to FIGS. 5, 6A and 6B.

Printing system 1 may use the results from step 220 in a post-processing step 230 for performing different tasks. Post-processing step 230 may include determining whether treatment printhead 14 ejects fixer fluid. For example, controller 48 may execute step 220; if no treated portion is located in print area 66, controller 48 may determine that treatment printhead 14 does not eject fixer fluid. Thereby, printing system 1 may determine whether any problem, such as clogging, affects treatment printhead 14.

Post-processing step 230 may include estimating a misalignment of a treatment printhead using a determined position of a treated portion as set forth below with respect to FIGS. 8 and 9. Further, a misalignment of treatment printhead 14 may be compensated during subsequent printing based on the result of the estimation.

Post-processing step 230 may include determining whether treatment printhead 14 applies fixer fluid at selected nominal densities or flow volumes. As set forth above, a color shift caused by a fixer fluid depends, among other factors, on the quantity of applied fluid. Further, the response to the color shift depends on the color shift, in particular on the contrast between reference color 68 and shifted color 70. Color shift response and quantity of applied fluid may be correlated using semi-empirical data. Controller 48 may analyze data acquired by optical sensor 24 for determining the color shift produced by the applied fixer fluid. From this analysis, controller 48 may infer the quantity of fixer fluid applied and determine whether ejection of fixer fluid by treatment printhead 14 deviates from particular nominal conditions.

Figure 5:
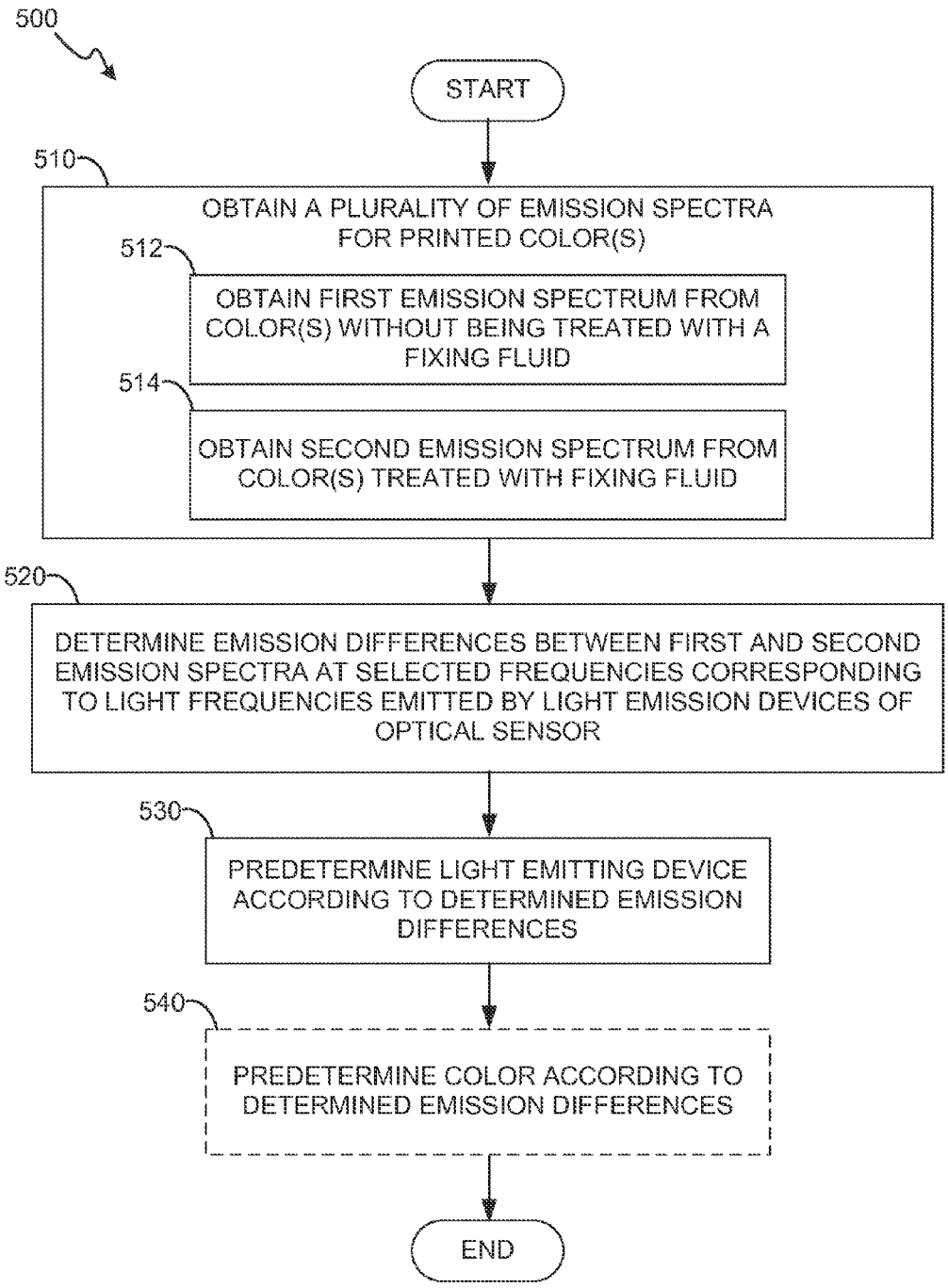
FIG. 5 is a process flow diagram of a method for predetermining operating conditions of a printing system according to an example herein.

As set forth above, a selected reference color and a selected LED may be predetermined for performing location of a treated portion. FIG. 5 is a process flow diagram of a method for predetermining operating conditions of a printing system according to an example herein. The illustrated process flow 500 can be used for predetermining an LED from the LEDs of an optical sensor used for location of a treated portion as described herein. For example, a predetermined LED can be selected for operating optical sensor 24 in process flow 200 described above. Further, the illustrated process flow 500 can be used for predetermining a color from a color gamut available to a particular printing system. For example, a predetermined color can be selected as reference color 68 in process flow 200 described above.

Figure 7:
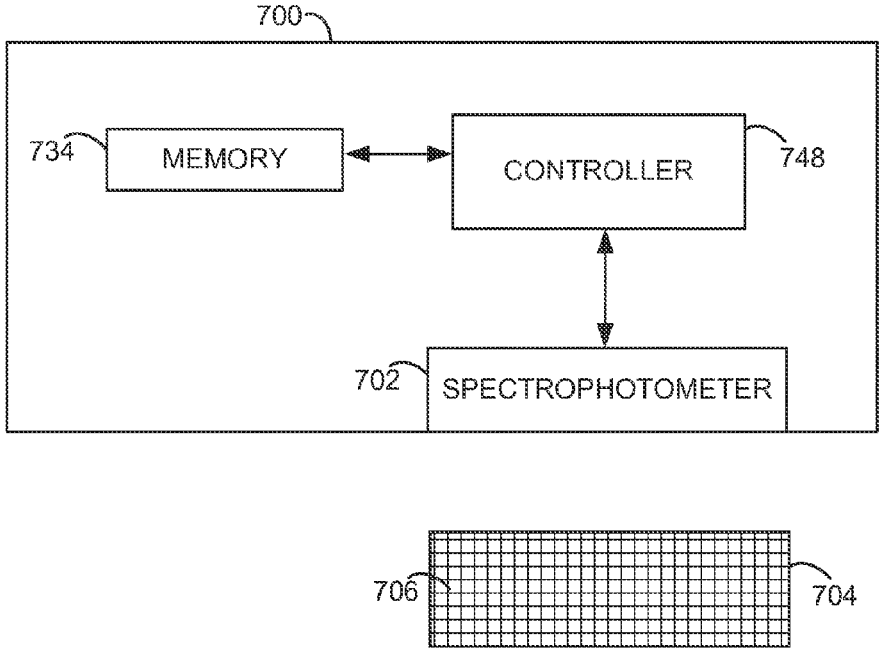
FIG. 7 is a schematic diagram of a dedicated system for executing the process flow of FIG. 5.

The depicted process flow 200 may be carried out by execution of sequences of executable instructions. In an example, the executable instructions are stored in a tangible machine readable storage medium. FIG. 7 schematically shows a system 700 for carrying out process flow 500. System 700 includes a system controller 748 operatively connected to a memory 734 and a spectrophotometer 702. System 700 may be a dedicated system for executing process flow 500, so that the process can be executed independently from printing system 1. Alternatively, system 700 may form part of printing system 1. It should be noted that process flow 500 may be executed by simulation of the process steps in an appropriate computer system using semi-empirical data.

System controller 748 and memory 734 may be constituted analogously as controller 48 and memory device 34 described above. Memory 734 may store operating conditions of printing system 1 predetermined by executing process flow 500. Predetermined values by system 700 may be provided to printing system 1 in different manners such us, but not limited to, by operatively communicating system 700 to printing system 1 or by manually storing the predetermined values in memory device 734.

Spectrophotometer 702 is a photometer that can measure light intensity as a function of the light source wavelength. In particular, spectrophotometer 702 can acquire an emission spectrum of a sample surface 704 printed with a color 706. For example, an emission spectrum can be acquired using a D50 standard illuminant and an XRite Eye-One spectrophotometer (X-Rite, Incorporated USA, Mi)

In the following, process flow 500 is described with reference to elements depicted in FIGS. 6A and 6B, which are simplified diagrams of emission spectra corresponding to printed colors.

At step 510, a plurality of emission spectra is obtained for one or more printed colors. For each of the printed colors, a spectral pair is acquired using spectrophotometer 702. In particular, at step 512, a first emission spectrum is acquired for the printed color without being treated with a fixer fluid. Further, at step 514, a second emission spectrum is obtained from the color treated with the fixer fluid. Step 510 may be executed by operating printing system 1 for printing a print medium with one or more colors at selected regions with and without fixer. That is, two areas may be printed for each color; one area is treated with fixer fluid, and another area remains untreated.

It will be understood that step 510 may be executed in different manners. For example, printing system 1 may print different print media with different colors with and without treatment. Further, the printed colors may be reproduced by a printing system different than printing system 1. Further, the printed colors may be colors not included in a color gamut of printing system 1. Using colors similar to those printed by printing system 1 may be sufficient for predetermining operating conditions of printing system 1; the color in the color gamut of printing system 1 most similar to the predetermined color may be selected. As set forth above, the emission spectra can also be obtained using simulation based on semi-empirical values.

Figure 6A:
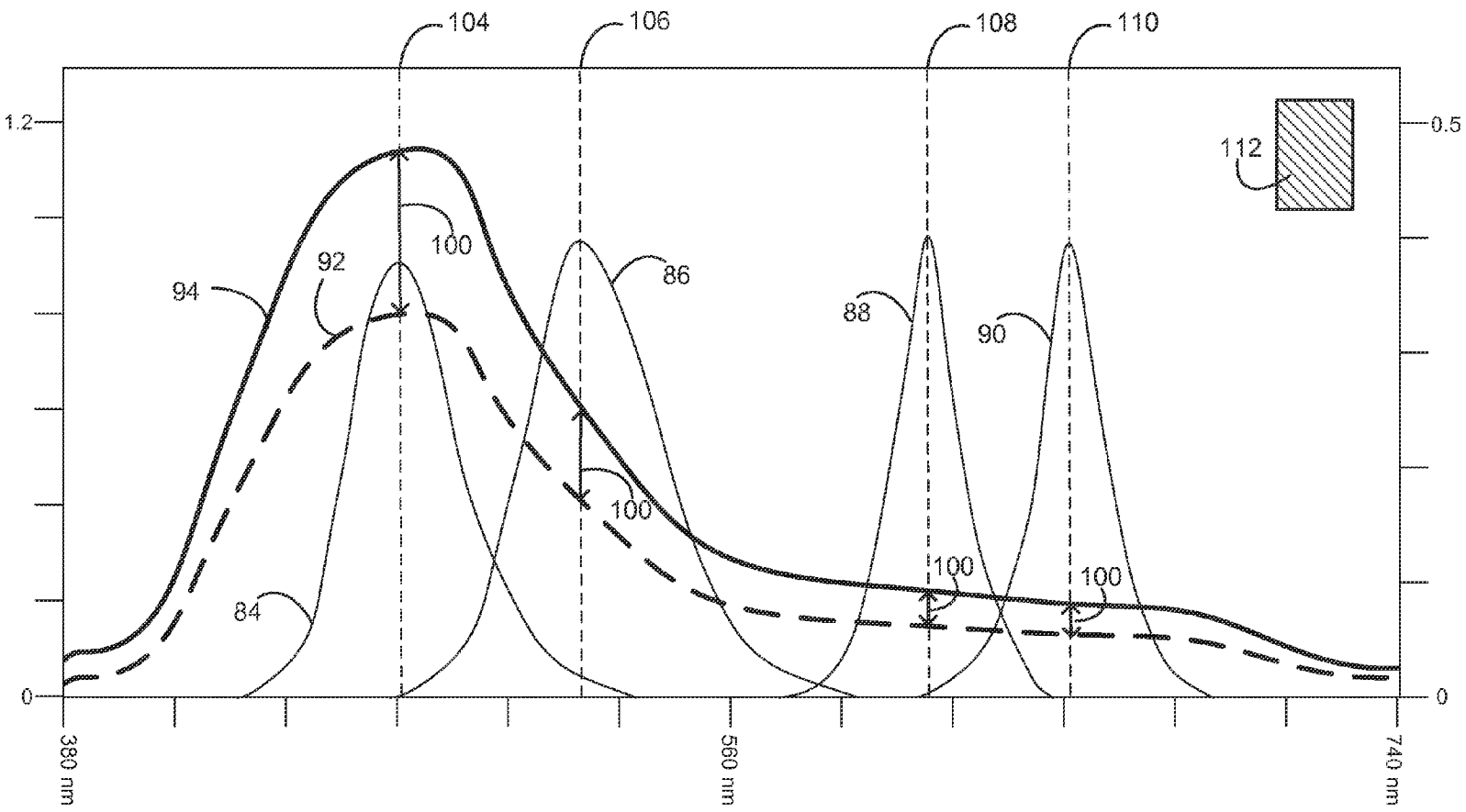
FIGS. 6A and 6B are simplified diagrams of emission spectra corresponding to printed colors.
Figure 6B:
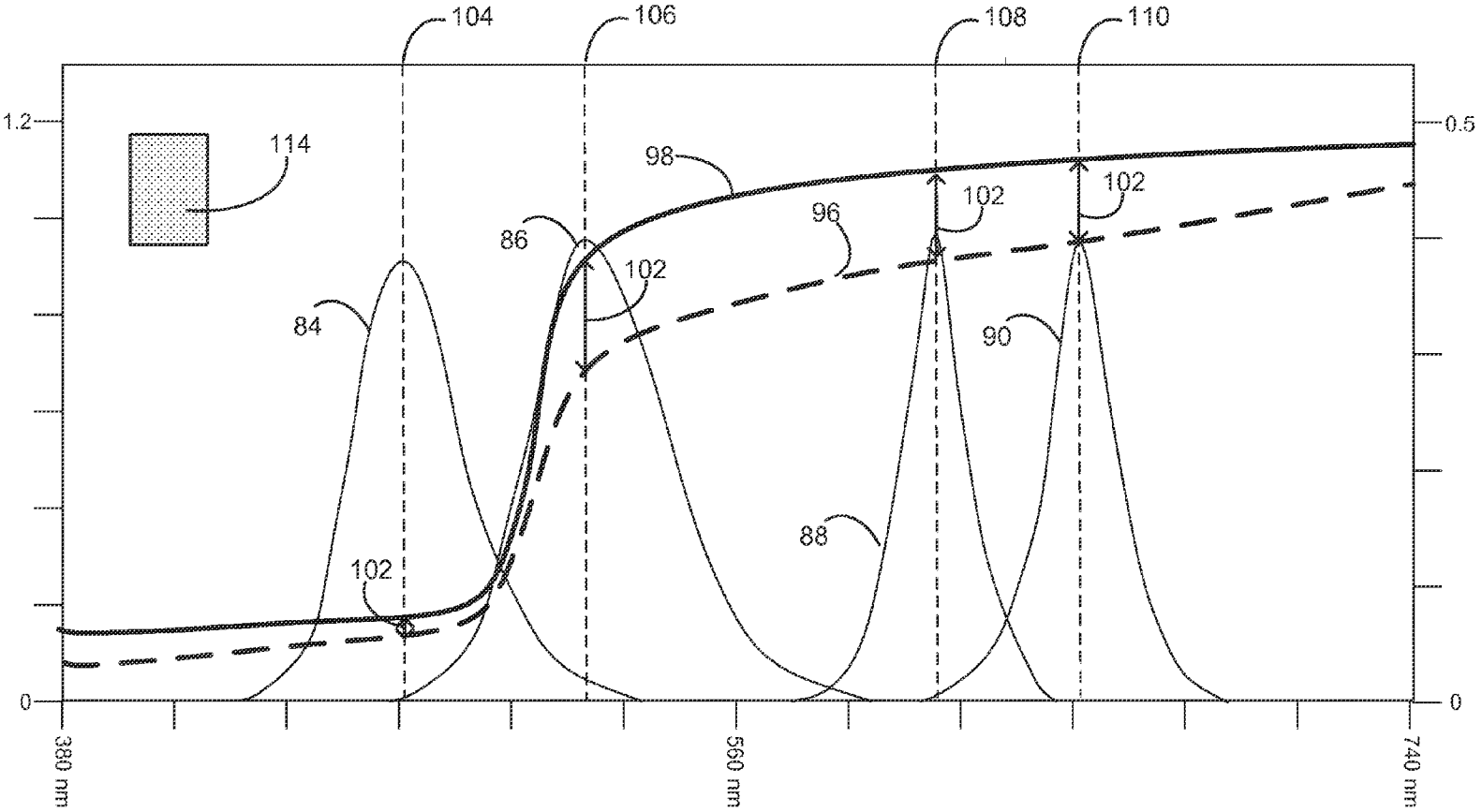

FIGS. 6A and 6B show emission spectra according to step 510. Emission spectrum 92 and emission spectrum 94 (see FIG. 6A) correspond, respectively, to the emission spectrum of color 112 untreated and emission spectrum of a color shifted from color 112 by treatment with fixer fluid. Emission spectrum 96 and emission spectrum 98 (see FIG. 6B) correspond, respectively, to the emission spectrum of color 114 untreated and emission spectrum of a color shifted from color 114 by treatment with fixer fluid. As illustrated, treatment with a fixer may cause a color shift which can be detected through differences between spectra corresponding to a color and spectra corresponding to the color shifted by fixer treatment. These differences may be quantified by calculating the area between both spectra.

After emission spectra are obtained, emission differences between the first emission spectrum and the second emission spectrum at different frequencies are determined at step 520. Typically, the determined emission differences indicate how optical sensor 24 responds to a color shift caused by a fixer fluid applied to a particular color. Step 520 may be performed for each of the printed colors used in step 510. In the shown examples, fixer treatment causes a color shift noticeable when the first and second spectra for a particular color are compared. The determined emission differences at step 520 correspond to differences resulting from treatment of a color with fixer fluid.

In some non-limiting examples, the emission differences are determined at selected frequencies 104, 106, 108, 110 corresponding to light emitted by the LEDs of optical sensor 24. The selected frequencies may correspond to peak frequencies of each of the emission spectra of the LEDs (i.e., the frequencies at which a color spectrum reaches a maximum). FIGS. 6A and 6B illustrate LED light spectra 84, 86, 88, 90 corresponding to light emitted by LEDs of optical sensor 24. In the example, LED light spectrum 84 corresponds to a blue LED having a peak frequency 104; LED light spectrum 86 corresponds to a green LED having a peak frequency 106; LED light spectrum 88 corresponds to an orange LED having a peak frequency 108; and LED light spectrum 90 corresponds to a red LED having a peak frequency 110.

A comparison between emission differences at different frequencies indicates which LED light facilitates an adequate response of optical sensor 24 to a color shift corresponding to treatment of a particular color. Therefore, an LED may be predetermined according to the determined emission differences. The predetermined LED may be selected in order to operate printing system 1 for performing step 220 of process flow 200. In particular, a predetermined LED as described herein may be selected during operation of printing system 1 for facilitating location of a treated portion. Further, the other LEDs may be turned off during the locating step such that sensitivity of light detection device 62 to a color shift caused by a fixer fluid is improved relative to operating all the LEDs of light detection device 62.

At step 530, an LED of optical sensor 24 is predetermined according to the determined emission difference. For a particular color, the highest emission difference indicates which LED light results in a higher response of optical sensor to a corresponding color shift. Typically, an LED is predetermined for improving the response of the optical sensor to a particular color shift. For example, the LED may be predetermined for maximizing the difference between photodetector response to untreated areas and photodetector response to treated areas.

For execution of step 530, controller 748 may first determine the emission differences 100 from data provided by spectrophotometer 702. Further, controller 748 may compare the determined emission differences and select an LED corresponding to the higher emission difference. In the illustrated example of FIG. 6A, the maximal emission difference for color 112 is at peak frequency 104, which corresponds to LED light spectrum 84 emitted by a blue LED. Accordingly, controller 748 may predetermine a blue LED for being selected during execution of step 220 (i.e., locating a treated portion) when reference color 68 corresponds to color 112. In the illustrated example of FIG. 6B, the maximal emission difference for color 114 is at peak frequency 106, which corresponds to LED light spectrum 86 emitted by a green LED. Accordingly, controller 748 may predetermine a green LED for being selected during execution of step 220 when reference color 68 corresponds to color 114.

A color may be predetermined from the printed colors referred to in step 510. Further, the predetermined color may be selected as reference color 68 during execution of step 220 in process flow 200 (i.e., locating a treated portion). In particular, emission differences determined in step 520 may be compared for different colors in order to assess which color is associated with a color shift caused by a particular fixer fluid that facilitates an adequate response of optical sensor 24. Accordingly, at step 540, a color is predetermined from the plurality of printed colors according to emission differences determined at step 520. Typically, the predetermined color corresponds to a color with the highest determined emission difference. For example, after executing step 520, controller 548 may compare emission differences for color 112 and color 114. Controller 548 may then determine that the highest emission difference corresponds to color 112. Accordingly, controller 748 may predetermine color 112 for being selected as reference color 68 in process flow 200.

Typically, the printed colors used in process flow 500 correspond to a color gamut of printing system 1. In particular, process flow 500 may be executed for a complete gamut of printing system 1. Executing process flow 500 for the complete gamut facilitates predetermining a reference color that improves sensitivity for locating a treated portion. If a predetermined color is not included in a color gamut of printing system 1, process flow 200 may be executed using the most similar color available to printing system 1. Both an LED and a reference color may be predetermined for improving the optical sensor response by choosing an LED and a reference color that maximize the optical sensor response to the color shift caused by a fixer fluid. In particular, the predetermination may be performed by testing color spectra corresponding to part of or the whole color gamut of printing system 1 and choosing the LED and the reference color that lead to the highest emission differences.

For locating a treated portion, e.g., by execution of process flow 200, at least one of a selected LED or a selected reference color may be predetermined for improving the response of optical sensor 24 to a color shift caused by a particular fixer fluid. In particular, both the LED and the reference color may be selected according to predetermined values such that the response of optical sensor 24 to a color shift caused by a particular fixer fluid is improved. For example, controller 548 may predetermine color 112 and the blue LED for being selected during execution of step 220 (i.e., locating a treated portion). Selection of a LED and a reference color predetermined as described herein facilitates maximizing the response of optical sensor 24 to a color shift caused by a particular fixer fluid.

As set forth above, an LED of the optical sensor or a reference color may be predetermined for improving the response of the optical sensor to a color shift, i.e., for facilitating the response of the optical sensor. In particular, a selected LED and a selected reference color may be predetermined such that the contrast between an untreated area (e.g., an area with reference color 68) and a treated area (e.g., an area with shifted color 70) can be detected by the optical sensor. Typically, the selected LED and the selected reference color are predetermined for maximizing this contrast.

As set forth above, a misalignment of a treatment printhead may be estimated using a determined position of a treated portion. FIG. 1 illustrates a misalignment of treatment printhead 14 caused by skew from a nominal position 14' (illustrated by a dashed line). Misalignment of treatment printhead 14 results in an incorrect placement of fixer fluid 40 on print medium 10. In the illustrated example, printing system 1 operates treatment printhead 14 for applying fixer fluid 40 over a vertical line 49. However, due to misalignment, fixer fluid 40 is applied on print medium 10 along a line 49', which is rotated relative to vertical line 49 an angle 50. Vertical line 49 corresponds to the theoretical positions where fixer fluid would be applied without misalignment, or with an accurate correction thereof.

It will be understood that misalignment of a treatment printhead may have other sources such as an incorrect placement of treatment printhead 14 in the vertical direction. Further, incorrect positioning of other elements of printing system 1, such as carriage 12 or carriage rod 4, may also cause misalignment of treatment printhead 14. A combination of different sources may also originate misalignment of treatment printhead 14.

Misalignment of treatment printhead 14 can be estimated by automatically determining the position of areas treated with a fixer fluid. In particular, treatment printhead 14 may apply a treatment fluid to multiple portions of print area 66. The treated portions may form a calibrating pattern. Further, the positions of the treated portions may be determined as set forth above. The determined positions may be compared to nominal positions in order to estimate misalignment of treatment printhead 14. As used herein, a nominal position refers to positioning data estimated by printing system 1 according to stored alignment data. The nominal positions correspond to positions where treated portions should be located if alignment data of treatment printhead 14 is accurate, e.g.: treatment printhead is not affected by misalignment, or misalignment is accurately corrected by printing system 1.

Figure 8:
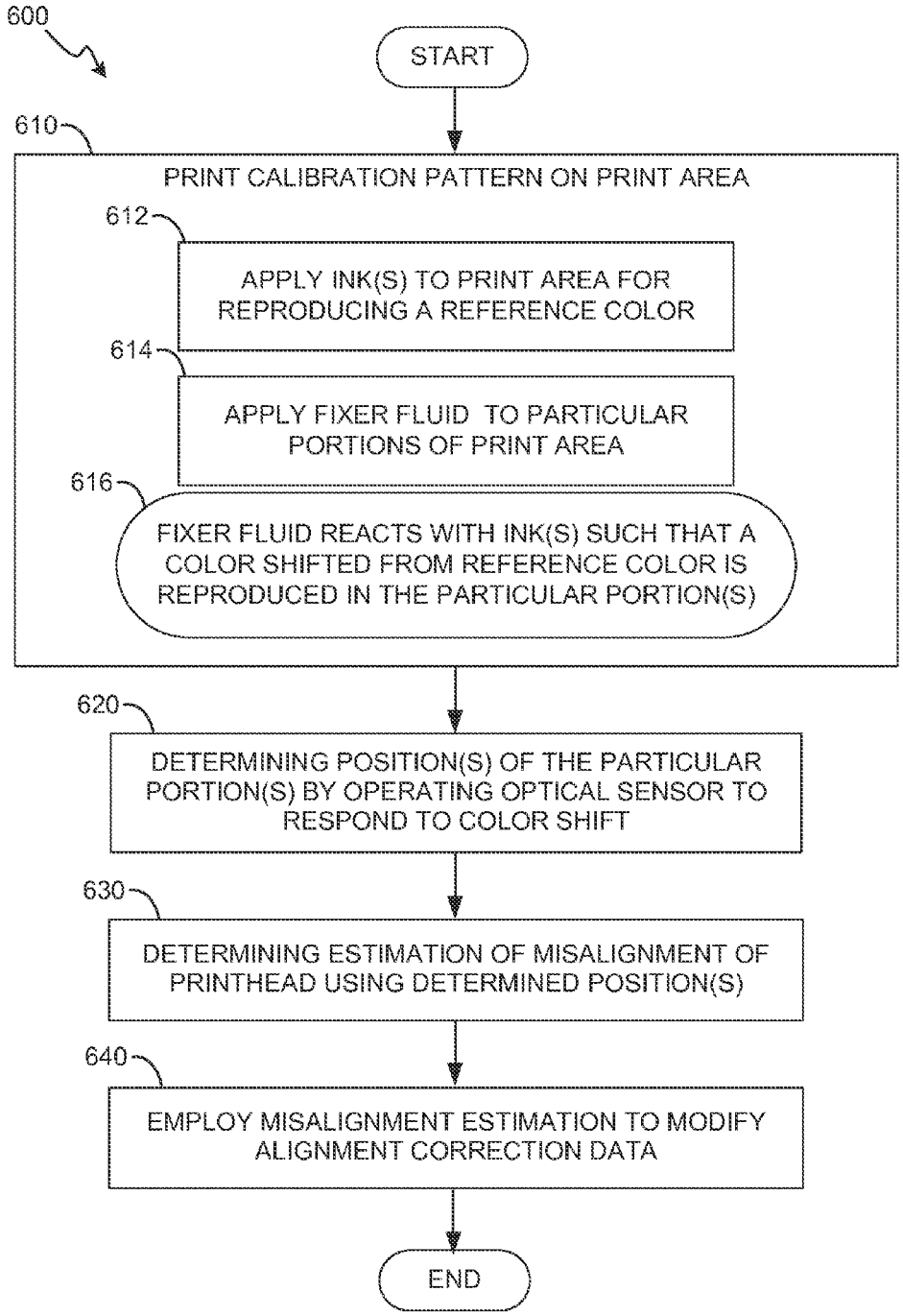
FIG. 8 is a process flow diagram for automatically aligning a treatment printhead according to an example herein.
Figure 9:
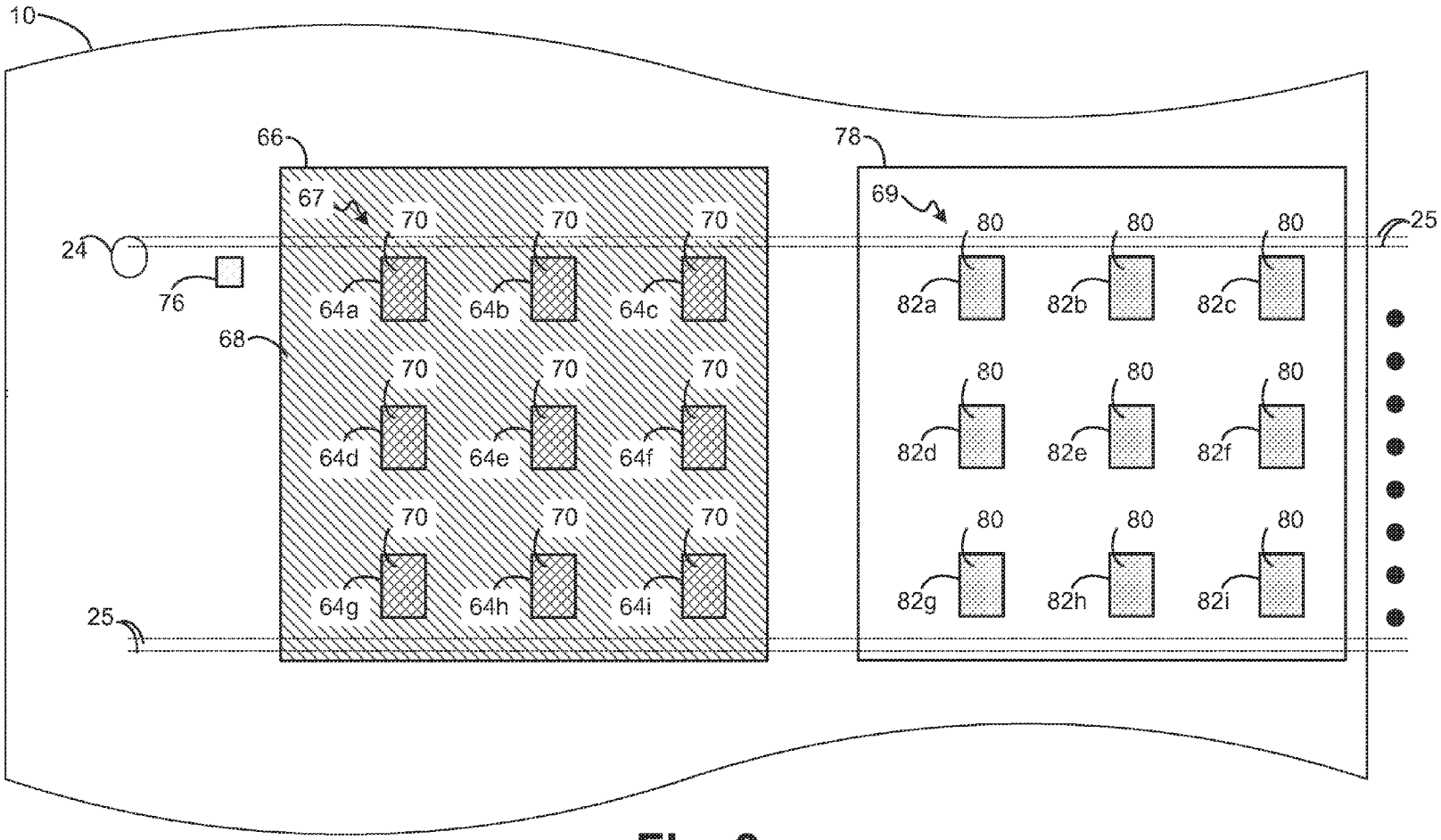
FIG. 9 schematically shows an arrangement for operation of an optical sensor according to another example herein.

FIG. 8 is a process flow diagram for automatically aligning a treatment printhead according to an example herein. The depicted process flow 600 may be carried out by execution of sequences of executable instructions. In an example, the executable instructions are stored in a tangible machine readable storage medium such as, but not limited to, memory device 34. Process flow 600 may be carried out by controller 48 or any other suitable element of a printing system.

Process flow 600 facilitates improving print quality of printing system 1. Process flow 600 may be performed at predetermined servicing intervals as part of routine maintenance of a printing system. Additionally or alternatively thereto, process flow 600 may be performed after events that may compromise alignment of a treatment printhead. For example, process flow 600 may be performed when a new treatment printhead is mounted on carriage 12 or after servicing of elements coupled to carriage 12 such as carriage rod 4. Additionally or alternatively thereto, a user may prompt a printer system, through a user terminal, to execute process flow 600, in particular when a user has indicia that a treatment printhead is misaligned (e.g., after noticing poor print quality.) A user terminal (not shown) may be configured to receive a user prompt to execute process flow 600 and send a suitable signal to controller 48 for executing the process.

In the following, process flow 600 is described with reference to elements depicted in FIG. 9, which schematically shows an arrangement for operation of an optical sensor according to an example herein.

At step 610, a fractional pattern 67 is printed on a print area 66. Typically, step 610 includes a step 612 of applying an ink selection to print area 66 for reproducing a reference color 68. For example, controller 48 may control the ink printheads so as to apply one or more inks for reproducing reference color 68 on print area 66, which thereby constitutes a background region. Typically, reference color 68 is predetermined using a method as illustrated in process flow 500 described above with regard to FIG. 5.

Step 610 may include a step 614 of applying a fixer fluid to particular portions of a print area so as to reproduce a shifted color 70. Shifted color 70 corresponds to a color shifted from reference color 68 by the interaction between ink applied at step 612 and fixer fluid. For example, controller 48 may control treatment printhead 14 so as to apply fixer fluid over portions 64*a* to 64*i*, on which ink is applied before or after the fixer fluid application. Typically, portions 64*a* to 64*i* are selected for composing a calibration pattern, i.e., a set of positions adequate for estimating misalignment of treatment printhead 14. The portion of print area 66 reproducing reference color 68 does not necessarily have to completely surround the treated portions 64*a* to 64*i* as illustrated in the figure: portions of print area 66 reproducing reference color 68 may be at the neighborhood of the treated portion 64 and/or may not completely fill print area 66.

Controller 68 controls positioning of treatment printhead 14 according to a set of alignment correction data 38. The correction data takes into account misalignments of treatment printhead estimated in a previous printhead alignment process. The previous printhead alignment process may be analogous to process flow 500. Typically, the set of alignment correction data 38 is stored at memory device 34. Further, controller 48 associates a nominal position to each of the treated portions.

Typically, the fixer fluid is applied before or quasi-simultaneously to the application of the ink selection for reproducing reference color 68. The fixer fluid may also be applied after the ink selection is applied. Similarly as set forth above, the applied fixer fluid reacts 616 with ink of the ink selection applied for reproducing reference color 68. Thereby, a color 70 shifted from reference color 68 (i.e., a shifted color 70) is reproduced in treated portions 64*a* to 64*i*.

The positions of treated portions 64*a* to 64*i* are determined at step 620. For example, controller 48 may operate optical sensor 24 for responding to a color shift caused by the fixer fluid in portions 64*a* to 64*i*. Optical sensor 24 is typically operated with a selected LED while turning off the other LEDs so as to increase sensitivity of the sensor to the color shift as set forth above. Such a sensitivity increase facilitates that optical sensor 24 detects a contrast between reference color 68 and shifted color 70 for accurately determining the positions of treated portions 64*a* to 64*i*. The selected LED may be predetermined using a method as illustrated in process flow 500 described above with regard to FIG. 5.

Typically, process flow 600 is performed as part of an alignment procedure for estimating misalignment of ink and treatment printheads. Therefore, further calibration patterns can be provided adjacent to print area 66 such as a print area 78. Print area 78 includes a calibration pattern 69 composed of a pattern of calibration dots 82*a* to 82*i*. Calibration dots 82*a* to 82*i* are printed with a color 80 reproduced by applying ink from one ink printhead, i.e., a base color. In the example, color 80 can be directly detected by optical sensor 24.

Optical sensor 24 is scanned over patterns 67, 69 following scanning lines 25 for detecting the positions of treated portions 64*a* to 64*i* and calibration dots 82*a* to 82*i*. A reference dot 76 is an indication for optical sensor 24 of the position of patterns 67, 69. During scanning, optical sensor 24 generates a signal corresponding to light projected from the LEDs and reflected from print medium 10 so that the position of treated portions 64*a* to 64*i* and calibration dots 82*a* to 82*i* can be determined.

At step 630, a misalignment of a treatment printhead is estimated using the determined position at step 620. For example, controller 48 may compare the determined positions of treated portions 64*a* to 64*i* with associated nominal positions. If the determined positions do not coincide with the nominal position, controller 48 determines that treatment printhead 14 is misaligned. Further, from a difference between determined positions and nominal positions, controller 48 can quantify the misalignment.

At step 640, misalignment estimation may be employed to modify correction data. For example, controller 48 may use a quantification of misalignment data for determining how a set of alignment correction data 38 should be modified in order to compensate misalignment of treatment printhead 14 during subsequent printing. In particular, controller 48 may determine that treatment printhead 14 is misaligned an angle 50 (shown in FIG. 1). Controller 48 may accordingly modify a set of alignment correction data 38 stored in memory device 34. During subsequent printing controller 48 generates motion signals for carriage 12 and firing signals for nozzle array such that misalignment is compensated. Thereby, it is facilitated that actual positions for applying fixer fluid coincide with the nominal positions. It will be understood that different methods can be employed for misalignment correction using misalignment estimation as described herein.

In principle, any suitable ink and fixer fluid may be used for implementing the examples described herein. In examples herein, ink and fixer fluid conditions (e.g., type and quantity) are chosen such that the fixer fluid causes a color shift that is detectable as described above. In some examples, the fixer fluid may consist of a cationic polymer for reducing colorant mobility or "fix" ink on a print medium. The ink and fixer compositions may comprise standard dye-based or pigment based inkjet ink and fixer solutions. As a non-limiting example, the fixer may include a water-based solution including acids, salts and organic counter ions and polyelectrolytes. The fixer may include other components such as biocides that inhibit growth of microorganisms, chelating agents (e.g., EDTA) that eliminate deleterious effects of heavy metal impurities, buffers, ultraviolet absorbers, corrosion inhibitors, and viscosity modifiers, which may be added to improve various properties of the ink and fixer compositions. In another example, the fixer may include a component that reacts with the ink. The component may have a charge opposite to the charge of the ink. For instance, if the ink is anionic, the fixer may include a cationic component. In addition, the fixer may be substantially devoid of a colorant or may include a colorant that does not absorb visible light The fixer fluid may also include a precipitating agent, such as a salt or an acid. The salt may include cations, such as calcium, magnesium, aluminum, or combinations thereof. The salt may include, but is not limited to, calcium nitrate, magnesium nitrate, or ammonium nitrate. The acid may be any mineral acid or an organic acid, such as succinic acid or glutaric acid. The precipitating agent may be used to change the conductivity or the pH of the ink, causing the pigment in the ink to precipitate on the surface of the print medium. The fixer may be over-printed and/or under-printed on the print medium relative to the ink.

Examples may be realized using water based latex-ink and fixer fluid suitable for fixing the latex-ink on the print medium. Thereby, quality of printing with latex-ink may be particularly improved, since latex-ink solutions may be more prone to color bleeding due to fluids in the ink solution. Other examples include solvent inks, water based inks, dye inks, or UV inks as well as fixer fluids appropriated thereto.

The print medium upon which the inkjet ink and/or fixer may be deposited may be any desired print medium. In examples, the print media may be a plain print medium or a commercially coated brochure print medium. Plain print media may include, but are not limited to, Hammermill(R) Fore DP paper, produced by International Paper Co. (Stamford, Conn.), HP Multi-Purpose paper, produced by Hewlett-Packard Inc. (Palo Alto, Calif.), uncoated polyester fabrics, polyester films, or vinyl banners. Commercially coated brochure print media, such as the type used to print brochures or business flyers, are typically hydrophobic and non-porous or less porous than plain paper, including "Lustro Laser", produced by SD Warren Company (Muskegon, Mich.) Other examples include, among others, self-adhesive vinyls, any PVC banners, Polyproline media, polyethylene media, PET media, or polyester fabrics. The print medium may include a raw material. The print medium may be pre-treated or coated materials.

The examples described above provide methods and systems for locating a portion of a print area, to which a fixer fluid is applied. As discussed above, the examples may be successfully deployed in case that the fixer fluid is transparent to detection by an optical sensor implemented in a particular printing system. However, the examples may also be used for any fixer fluid causing a color shift detectable, e.g., by analyzing color spectra differences as described herein or any other suitable method.

It will be appreciated that examples can be realized in the form of hardware, software module or a combination of hardware and the software module. Any such software module, which includes machine-readable instructions, may be stored in the form of volatile or non-volatile storage such as, for example, a storage device like a ROM, whether erasable or rewritable or not, or in the form of memory such as, for example, RAM, memory chips, device or integrated circuits or on an optically or magnetically readable medium such as, for example, a CD, DVD, magnetic disk or magnetic tape. It will be appreciated that the storage devices and storage media are examples of a non-transitory computer-readable storage medium that are suitable for storing a program or programs that, when executed, for example by a processor, implement examples. Accordingly, examples provide a program comprising code for implementing a system or method as claimed in any of the accompanying claims and a non-transitory computer readable storage medium storing such a program.

In the foregoing description, numerous details are set forth to provide an understanding of the examples disclosed herein. However, it will be understood by those skilled in the art that the examples may be practiced without these details. While a limited number of examples have been disclosed, those skilled in the art will appreciate numerous modifications and variations therefrom. It is intended that the appended claims cover such modifications and variations as fall within the true spirit and scope of the disclosed examples.

What is claimed is:

1. A method of operating a printing system, the method comprising:

locating at least one portion of a print area by operating an optical sensor of the printing system to respond to a color shift from a printed reference color, the color shift being caused by a fixer fluid applied to the at least one portion, wherein the reference color is predetermined for improving the response of the optical sensor to the color shift, and from a plurality of printed colors by:

obtaining a plurality of emission spectra for the plurality of printed colors, the plurality of emission spectra including, for each of the printed colors, a first emission spectrum obtained from the color without being treated with the fixer fluid and a second emission spectrum obtained from the color treated with the fixer fluid;

determining, for each of the printed colors, emission differences between the first emission spectrum and the second emission spectrum at different frequencies, the emission differences resulting from treatment of the color with the fixer fluid; and predetermining the reference color from the plurality of printed colors according to the determined emission differences.

2. The method of claim 1, wherein the reference color is predetermined by comparing light emission spectra from a plurality of printed colors.

3. The method of claim 1, wherein:

the optical sensor includes a light detection device and a plurality of light emission devices; and the optical sensor is operated to respond to the color shift with a light emission device selected from the plurality of light emission devices.

4. The method of claim 3, wherein the selected light emitting device is predetermined by comparing a fight emission spectrum from a printed test color and a light emission spectrum from a printed color shifted from the test color by applying the fixer fluid.

5. The method of claim 4, wherein the selected light emitting device is predetermined for improving the response of the optical sensor to the color shift.

6. The method of claim 4, wherein the selected light emitting device is predetermined from the plurality of light emission devices of the optical sensor by:

obtaining a plurality of emission spectra for one or more printed colors, the plurality of emission spectra including, for each of the printed colors, a first emission spectrum obtained from the color without being treated with the fixer fluid and a second emission spectrum obtained from the color treated with the fixer fluid;

determining for the one or more printed colors emission differences between the first emission spectrum and the second emission spectrum at different frequencies, the emission differences resulting from treatment of the color with the fixer fluid; and predetermining the selected light emitting device according to the determined emission differences.

7. The method of claim 1, wherein:

a printhead of printing system performs the application of the fixer fluid to the at least one portion of the print area;

locating the at least one portion further includes determining a position of the at least one portion; and the method further includes estimating a misalignment of the printhead using the determined position of the at least one portion.

8. The method of claim 7 further comprising compensating a misalignment of the printhead during subsequent printing based on the result of the estimation of printhead misalignment.

9. The method of claim 1, wherein the fixer fluid is transparent to detection by the optical sensor.

10. The method of claim 1, wherein the fixer fluid is for preventing at least one of color bleed or coalescence of one or more color inks applied to the print area for reproducing the reference color.

11. A printing system for printing a print medium, comprising:

a treatment printhead to eject a fixer fluid;

an ink printhead assembly including a plurality of ink printheads to eject ink;

an optical sensor to illuminate a portion of the print medium with light and detect light reflected from the print medium the optical sensor including a light detection device and a plurality of light emission devices; and a controller to:

control the ink printhead assembly so as to apply one or more inks on a background region for reproducing a selected reference color, wherein the reference color is predetermined for improving a response of the optical sensor to a color shift caused by the fixer fluid that was ejected, and from a plurality of printed colors by:

obtaining a plurality of emission spectra for the plurality of printed colors, the plurality of emission spectra including, for each of the printed colors, a first emission spectrum obtained from the color without being treated with the fixer fluid and a second emission spectrum obtained from the color treated with the fixer fluid;

determining, for each of the printed colors, emission differences between the first emission spectrum and the second emission spectrum at different frequencies, the emission differences resulting from treatment of the color with the fixer fluid; and predetermining the reference color from the plurality of printed colors according to the determined emission differences; and control the treatment printhead so as to apply fixer fluid over at least one portion of the background region, the fixer fluid being capable of reacting with the one or more inks such that a color shifted from the reference color is reproduced in the at least one portion;

operate the optical sensor for detecting a contrast between the shifted color and the reference color so as to determine the position of the at least one portion, the optical sensor being operated with a light emission device selected from the plurality of light emission devices;

determine an estimation of a misalignment of the treatment printhead using the determined position; and modify alignment correction data for compensating printhead misalignment during subsequent printing according to the misalignment estimation.

12. The printing system of claim 11, wherein the selected light emitting device and the selected reference color are predetermined for improving the response of the optical sensor to the color shift.

13. A tangible machine readable storage medium storing instructions that when executed implement a method performed by a printing system, comprising:

locating at least one portion of a print area by operating an optical sensor operated with a light emission device selected from a plurality of light emission devices to respond to a color shift from a selected reference color, the color shift being caused by a fixer fluid applied to the at least one portion, wherein the selected reference color was selected, for improving a response of the optical sensor to the color shift, and wherein the selected reference color was selected from a plurality of printed colors by:

obtaining a plurality of emission spectra for the plurality of printed colors, the plurality of emission spectra including, for each of the printed colors, a first emission spectrum obtained from the color without being treated with the fixer fluid and a second emission spectrum obtained from the color treated with the fixer fluid;

determining, for each of the printed colors, emission differences between the first emission spectrum and the second emission spectrum at different frequencies, the emission differences resulting from treatment of the color with the fixer fluid; and predetermining the reference color from the plurality of printed colors according to the determined emission differences.

* * * * *

UNITED STATES PATENT AND TRADEMARK OFFICE

CERTIFICATE OF CORRECTION

PATENT NO. : 9,044,959 B2
APPLICATION NO. : 14/346255
DATED : June 2, 2015
INVENTOR(S) : Eduardo Amela Conesa et al.

It is certified that error appears in the above-identified patent and that said Letters Patent is hereby corrected as shown below:

In the claims

In column 15, line 54, in Claim 4, delete “fight” and insert -- light --, therefor.

In column 16, line 35, in Claim 11, delete “medium the” and insert -- medium, the --, therefor.

Signed and Sealed this
Fifteenth Day of December, 2015

Michelle K. Lee

Michelle K. Lee
*Director of the United States Patent and Trademark Office*